US011646552B2

(12) United States Patent
Mauchle et al.

(10) Patent No.: US 11,646,552 B2
(45) Date of Patent: May 9, 2023

(54) CASCADE INSERT FOR AN IONIZING BAR AND IONIZING BAR HAVING A CASCADE INSERT

(71) Applicant: GEMA SWITZERLAND GMBH, St. Gallen (CH)

(72) Inventors: Felix Mauchle, Abtwil (CH); Michael Nagel, Constance (DE)

(73) Assignee: GEMA SWITZERLAND GMBH, St. Gallen (CH)

( * ) Notice: Subject to any disclaimer, the term of this patent is extended or adjusted under 35 U.S.C. 154(b) by 141 days.

(21) Appl. No.: 17/310,953

(22) PCT Filed: Feb. 27, 2020

(86) PCT No.: PCT/EP2020/055076
§ 371 (c)(1),
(2) Date: Sep. 1, 2021

(87) PCT Pub. No.: WO2020/178109
PCT Pub. Date: Sep. 10, 2020

(65) Prior Publication Data

US 2022/0209510 A1 Jun. 30, 2022

(30) Foreign Application Priority Data

Mar. 1, 2019 (DE) ..... 102019105231.9

(51) Int. Cl.
*H01T 23/00* (2006.01)
*H01T 19/00* (2006.01)

(52) U.S. Cl.
CPC ..... *H01T 23/00* (2013.01); *H01T 19/00* (2013.01)

(58) Field of Classification Search
CPC ..... H01T 23/00; H01T 19/00; H01T 19/04; H05F 3/04
(Continued)

(56) References Cited

U.S. PATENT DOCUMENTS 6,653,638 B2 * 11/2003 Fujii ..... H01T 23/00 250/326
8,035,948 B2 * 10/2011 Onezawa ..... H01T 23/00 361/220
(Continued)

FOREIGN PATENT DOCUMENTS

DE 10116993 A1 11/2002
DE 102009033827 B3 3/2011
(Continued)

OTHER PUBLICATIONS

International Preliminary Report on Patentability dated Sep. 2, 2021, received for corresponding PCT Application No. PCT/EP2020/055076, seven pages.
(Continued)

*Primary Examiner* — Dharti H Patel
(74) *Attorney, Agent, or Firm* — Kinney & Lange, P.A.

(57) ABSTRACT

Disclosed is a cascade insert for an ionising bar for the contactless neutralising of electrostatic charges and/or for contactless charging, in particular of insulation materials. The cascade insert includes a housing having at least one cascade circuit which has at least one transformer and a one- or multiple-stage cascade unit, said circuit units being potted with a potting material, and the output of the cascade circuit is coupled capacitively, inductively or resistively with a plurality of electrode points which are accommodated in a carrier extending in the direction of extension of the housing.

12 Claims, 2 Drawing Sheets

(58) Field of Classification Search
USPC ..... 361/231
See application file for complete search history.

(56) References Cited

U.S. PATENT DOCUMENTS

| | | | | |
|---|---|---|---|---|
| 11,502,483 | B2 * | 11/2022 | Guthrie | B03C 3/41 |
| 2005/0270722 | A1 * | 12/2005 | Gorczyca | H01T 23/00 361/230 |
| 2008/0130190 | A1 * | 6/2008 | Shimada | H01T 23/00 361/231 |
| 2009/0116162 | A1 | 5/2009 | Onezawa et al. | |
| 2013/0258543 | A1 * | 10/2013 | Suzuki | H01T 23/00 361/231 |

FOREIGN PATENT DOCUMENTS

| | | | |
|---|---|---|---|
| DE | 102012207219 | A1 | 10/2013 |
| DE | 102016101497 | B2 | 5/2017 |
| EP | 2775575 | A1 | 9/2014 |
| JP | H05289471 | A | 11/1993 |

OTHER PUBLICATIONS

International Search Report and Written Opinion dated May 25, 2020, for corresponding PCT Application No. PCT/EP2020/055076.

First German Office Action dated Apr. 30, 2014, for corresponding German Application No. 10 209 105 231.9.

* cited by examiner

CASCADE INSERT FOR AN IONIZING BAR AND IONIZING BAR HAVING A CASCADE INSERT

CROSS-REFERENCE TO RELATED APPLICATION(S)

This application is a Section 371 National Stage Application of International Application No. PCT/EP2020/055076, filed on Feb. 27, 2020, which claims priority to German Application No. 102019105231.9, filed on Mar. 1, 2019, entitled "CASCADE INSERT FOR AN IONISING BAR AND IONISING BAR HAVING A CASCADE INSERT", the contents of which are incorporated by reference herein in their entireties.

BACKGROUND

The present disclosure relates to an ionizing bar for the non-contact neutralizing of electrostatic charges and/or for non-contact charging, particularly of insulating materials, as well as a cascade insert for such an ionizing bar.

One aspect of the present disclosure relates in particular to a rod-shaped ionizing electrode designed as an active discharge electrode and serving to for example minimize positive and/or negative charges particularly on moving material webs. Alternatively thereto, the ionizing electrode can also serve in the targeted charging of material webs. The rod-shaped ionizing electrode according to these embodiments comprises a plurality of individual needle-shaped electrodes arranged parallel to one another which are inductively, capacitively or resistively connectable to a high-voltage transformer via an ohmic resistor and provided as a single row of the multiple parallel-arranged individual electrodes.

Electrodes for corona pretreatment are in principle known from the prior art. Reference is made in this context to printed publication DE 1 923 098 A1, for example. A high-frequency plasma is used with such electrodes to materially modify or respectively pretreat a material web surface, in particular a film surface. However, only charging and no discharging occurs in this case and a grounded counter-electrode is moreover required.

Discharge electrodes are known in a plurality of embodiments as passive discharge electrodes in the form of grounded tips or tongues. There are moreover also so-called active discharge electrodes which are able to be connected to a high-voltage alternating current source. They serve in discharging or eliminating positive and/or negative charge on the surface of preferably rapidly moving material webs such as those used for example in gravure printing.

In most cases, these known active discharge electrodes exhibit at least multiple rows of individual needle-shaped electrodes arranged parallel to one another, these being provided in a parallel row arrangement with a tip at their free end and connectable to a high voltage source. At least one non-insulated conductor is arranged along a row of electrodes, preferably parallel thereto.

The present disclosure is based on the task of specifying a rod-shaped ionizing electrode which is of particularly flexible use and in particular characterized by its simple structure.

SUMMARY

An aspect of the present disclosure relates to a cascade insert for an ionizing bar for the non-contact neutralizing of electrostatic charges and/or for non-contact charging, particularly of insulating materials, wherein the cascade insert exhibits a housing having at least one cascade circuit comprising at least one transformer and a single or multi-stage cascade unit. These circuit units (transformer and cascade unit) are potted with a potting material, whereby the output of the cascade circuit is capacitively, inductively or resistively coupled to a plurality of electrode tips accommodated in a carrier extending along the housing's direction of extension.

The cascade insert according to the present disclosure is in particular a modularly structured insert able to be flexibly used and/or interchanged in an ionizing bar. Moreover, the cascade insert itself is characterized by its modular structure comprising at least one cascade circuit incorporated into a potting compound which in turn can be selectively and when necessary interchanged.

Thus, one advantageous implementation of the disclosed cascade insert provides for a plurality of cascade circuits which are each cast in potting material to be arranged one behind the other in the housing of the cascade insert as viewed in the housing's longitudinal direction.

It is further advantageous for control electronics to be accommodated in the housing of the cascade insert, preferably in the form of a modular block, in order to applicably control the at least one cascade circuit of the cascade insert. It is thereby expedient to preferably provide the control electronics in an end region of the cascade insert housing and adjacent to one of the at least one cascade circuits. In this context, it is then conceivable for the carrier accommodating the plurality of the electrode tips of the cascade circuit to extend in the longitudinal direction of the housing at least partially over the end region of said housing in which the control electronics is accommodated.

In so doing, an active electrode arrangement can be provided over the entire length of the cascade insert.

Provided according to further developments of the disclosed cascade insert is for at least one electrical connection for supplying energy to the at least one cascade circuit and at least one data interface for data communication with the control electronics to be provided, preferably in an end face of an end region of the housing in which the control electronics is accommodated. The at least one data interface and the control electronics are thereby preferably designed for bidirectional communication, particularly via a CAN bus.

Alternatively or additionally to the aforementioned aspect, embodiments of the disclosed cascade insert preferably provide for an interface for manually inputting control commands to the control electronics in an end face of the housing's end region in which the control electronics is accommodated. Further or alternatively advantageous thereto is for a display device for the optical output of information to the user of the cascade insert, in particular in the form of at least one LED and/or in the form of a display, to likewise be provided in the end face of the housing's end region in which the control electronics is accommodated.

According to embodiments of the disclosed cascade insert, it is provided for the at least one cascade circuit to further comprise at least one oscillator likewise cast with the potting material. Alternatively thereto, it is however also conceivable to allocate a corresponding oscillator to the control electronics (and not the cascade circuit). It is thereby generally provided for the at least one oscillator to be a digital oscillator exhibiting no power loss.

The modular structure of the cascade insert enables the individual cascade circuits accommodated in the housing to be switched on or off individually and as needed in order to thereby change an operating mode of the cascade insert (and in the figurative sense, the ionizing bar fitted with the cascade insert).

According to further embodiments of the present disclosure, it is provided for the plurality of electrode tips of the individual cascade circuits accommodated in the housing to be able to coupled to one another, in particular capacitively, inductively, resistively or galvanically coupled or when needed. Doing so enables electrodes to be switched on or off in certain areas, which further enlarges the scope of application of the disclosed cascade insert.

In general, particularly the module-like or modular structure of the cascade insert enables the individual cascade circuits accommodated in the housing to be accommodated in said cascade insert housing in preferably individually interchangeable manner and in particular be galvanically connected to one another via plug connections.

The present disclosure further relates to an ionizing bar for the non-contact neutralizing of electrostatic charges, particularly of insulating materials, wherein the ionizing bar has an outer housing in the form of an open profile and at least one cascade insert of the aforementioned type. The open profile of the ionizing bar's outer housing thereby exhibits a geometry adapted to the outer geometry of the cascade insert's housing, and specifically such that the at least one cascade insert can be accommodated in the outer housing of the ionizing bar in at least partially interchangeable manner.

According to embodiments of the ionizing bar, the outer housing exhibits a carrier extension aligned with the carrier of the at least one cascade insert in the longitudinal direction of said outer housing in which are accommodated a plurality of electrode tips which are preferably galvanically coupled to the electrode tips accommodated by the carrier of the at least one cascade insert.

BRIEF DESCRIPTION OF THE DRAWINGS

The following will reference the accompanying drawings in describing an exemplary embodiment of the disclosed ionizing bar for the non-contact neutralizing of electrostatic charges in greater detail.

Shown are:

FIG. 1.

DETAILED DESCRIPTION

Figure 1:
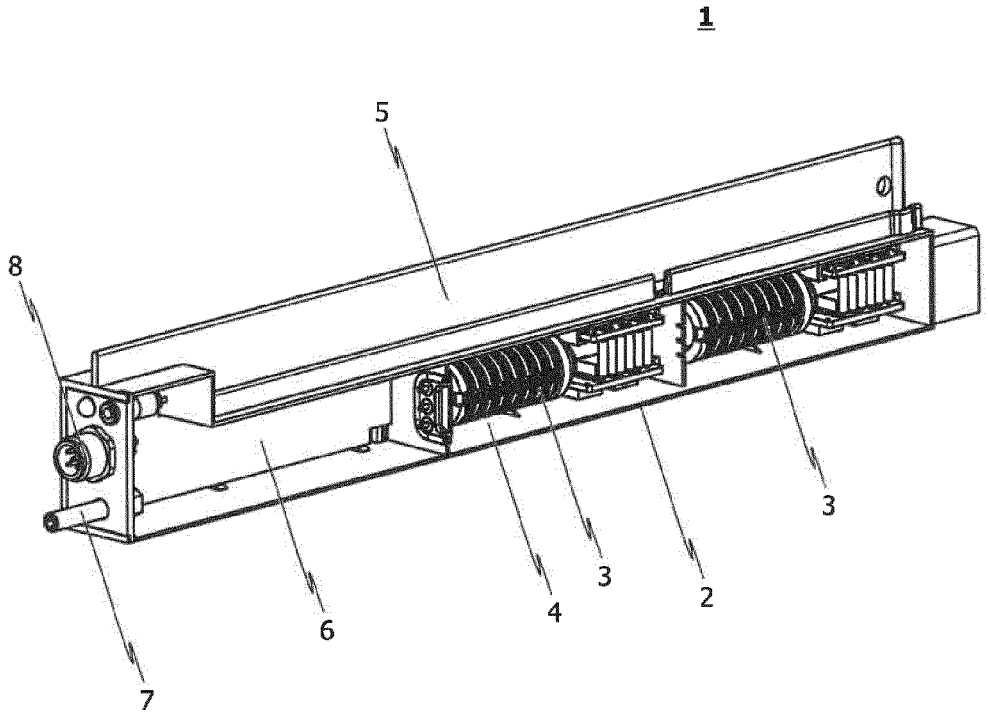
FIG. 1 a schematic and isometric partly sectional exploded view of an exemplary embodiment of the ionizing bar according to the present disclosure.

The exemplary embodiment of the ionizing bar 20 according to the present disclosure is in particular suitable for non-contact neutralizing of electrostatic charges and/or for selective charging (either positive or negative), particularly of insulating materials. The ionizing bar 20 comprises an outer housing 21, for example in the form of a partially open profile. A cascade insert 1 is at least partially accommodated, preferably interchangeably, in the outer housing 21.

In particular thereby provided is for the outer housing 21 with the cascade insert 1 at least partially accommodated in said outer housing 21 to be able to be mounted transverse to the direction of motion of a substrate to be treated (not depicted in the drawings).

The ionizing bar 20 is in particular suitable as an antistatic device for reducing electrostatic charges on moving webs of material. It is particularly characterized by its simplified handling and improved operability as well as by reduced dimensions. To that end, all the components of the ionizing bar 20 necessary for operation are integrated into the cascade insert 1 which is accommodated or able to be incorporated into the outer housing 21 of the ionizing bar 20 in preferably interchangeable manner.

The cascade insert 1 is in particular a modularly structured insert able to be flexibly used and/or interchanged in an ionizing bar 20. In the embodiment shown in FIG. 1, it is provided for two cascade circuits 3 which are each cast in potting material 4 to be arranged one behind the other in the housing 2 of the cascade insert 1 as viewed in the longitudinal direction of the housing 2.

Further provided is for control electronics 6 to be accommodated in the housing 2 of the cascade insert 1, preferably in the form of a modular block, in order to applicably control the at least one cascade circuit 3 of the cascade insert 1. Expedient here is preferably providing the control electronics 6 in an end region of the housing 2 of the cascade insert 1 and adjacent to one of the at least one cascade circuits 3. Conceivable in this context is then for the carrier 5 of the cascade insert 1 accommodating the plurality of the electrode tips of the cascade circuit 3 to extend in the longitudinal direction of the housing 2 at least partially over the end region of the housing 2 in which the control electronics 6 is accommodated.

Further provided for is at least one electrical connection 7 for supplying energy to the at least one cascade circuit 3 and at least one data interface 8 for data communication with the control electronics 6, these provided preferably in an end face of an end region of the housing 2 in which the control electronics 6 is accommodated. The at least one data interface 8 and the control electronics 6 are thereby preferably designed for bidirectional communication, particularly via a CAN bus.

Additionally thereto, the cascade insert 1 comprises an interface for the manual input of control commands to the control electronics 6 in an end face of the end region of the housing 2 in which the control electronics 6 is accommodated. Further or alternatively thereto, it is of advantage for a display device, in particular in the form of at least one LED and/or in the form of a display, to be provided, likewise in the end face of the end region of the housing 2 in which the control electronics 6 is accommodated, for the optical output of information to the user of the cascade insert 1.

Figure 2:
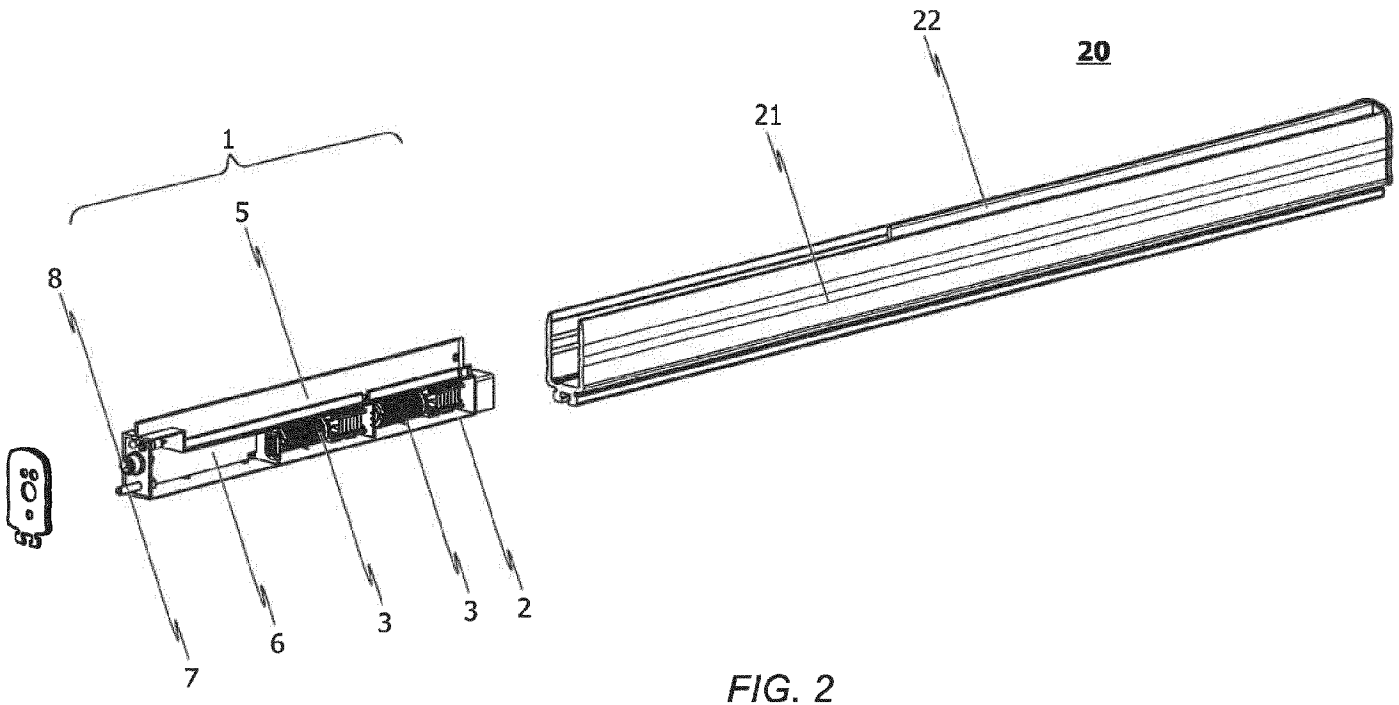
FIG. 2 a schematic and isometric partly sectional view of an exemplary embodiment of the cascade insert used in the disclosed ionizing bar according to e.g.

FIG. 2 shows an exploded view of one embodiment of the ionizing bar 20 for the non-contact neutralizing of electrostatic charges. The ionizing bar 20 has an outer housing 21 in the form of an open profile and at least one cascade insert 1 of the aforementioned type. The open profile of the outer housing 21 of the ionizing bar 20 thereby exhibits a geometry adapted to the outer geometry of the housing 2 of the cascade insert 1 and specifically such that the at least one cascade insert 1 can be accommodated in the outer housing 21 of the ionizing bar 20 in at least partially interchangeable manner.

The outer housing 21 further comprises a carrier extension 22 aligned with the carrier 5 of the at least one cascade insert 1 in the longitudinal direction of said outer housing 21 in which are accommodated a plurality of electrode tips 9 which are preferably galvanically coupled to the electrode tips 9 accommodated by the carrier 5 of the at least one cascade insert 1.

The ionizing bar 20 can comprise at least one active electrode arrangement having a plurality of preferably needle-shaped individual electrodes and electrically connected to an associated voltage source during operation of the ionizing bar 20. The voltage source is thereby expediently designed as a high voltage source in order to apply a corresponding high voltage to the electrode arrangement. These are thereby usually voltages of around 1000 V and higher.

The voltage source is therefore also referred to as a "high voltage source" in the following, whereby it should be clear that the voltage source can also provide lower voltages.

The ionizing bar 20 further comprises a control device which controls the high-voltage source connected to the electrode arrangement. The control device is preferably accommodated in the cascade insert 1 of the ionizing bar 20.

The high-voltage source is preferentially also arranged in the cascade insert 1 of the ionizing bar 20. This enables an additional improvement in the ionizing bar's handling, particularly because a separate connection 7 of the ionizing bar or of the cascade insert 1 respectively to a high-voltage source external of the ionizing bar 20 can be dispensed with.

The electrode arrangement of the ionizing bar 20, and in particular the individual electrodes, serve the purpose of building up an electrical potential relative to a moving material web so as to reduce any existing electrostatic charge there may be on the material web. To that end, an electrical resistor can be connected upstream of the respective individual electrode. The control device is appropriately designed or respectively programmed to control the high-voltage source so as to build up an electrical potential resulting in a reduction of the electrostatic charges on the material web. It can in particular be provided for a negative high voltage to be applied to the individual electrodes when the electrostatic charges on the material web are positive, the material web thus being positively charged. It can accordingly also be provided for a positive voltage to be applied to the electrodes of the electrode arrangement when the electrostatic charges on the material web are negative, the material web thus being negatively charged. Preferentially, a dissipating of the electrostatic charges on the material web occurs in both cases, whereby the electrostatic charges on the material web are reduced and ideally neutralized.

According to one embodiment (not depicted in the drawing), the ionizing bar 20 comprises two active electrode arrangements, namely one active positive electrode arrangement having a plurality of active needle-shaped individual positive electrodes and one active negative electrode arrangement having a plurality of active needle-shaped individual negative electrodes. The positive electrode arrangement can thereby be connected to a high-voltage source which is positively charged and accordingly referred to as a positive high-voltage source while the negative electrode arrangement can be connected to a negative high-voltage source which can be referred to as a negative high-voltage source. The positive electrode arrangement and the negative electrode arrangement are expediently arranged together in the outer housing 21 of the ionizing bar 20.

The respective positive electrodes and negative electrodes can thereby run along parallel lines alongside the ionizing bar 20 or an end face of the ionizing bar 20 respectively. Embodiments are also conceivable in which the positive electrodes and negative electrodes are alternatingly arranged along a common line. Such a configuration to the ionizing bar 20 results in a further reduction in the size ratio of the ionizing bar 20 because it does away with the need for different and separated housings 2 for the respective placement of the positive electrode arrangement or negative electrode arrangement.

According to the embodiment depicted in the drawings, the ionizing bar 20 comprises power electronics, likewise integrated into the cascade insert 1. The power electronics in particular serves the purpose of converting a primary electrical supply available to the ionizing bar 20 pursuant to that as required for the operation of said ionizing bar 20. The primary electrical supply is thereby usually a generally available electrical supply, particularly in the form of an electric current or electric voltage able to be drawn from an ordinary electrical outlet of a power grid operator. In this context, a low-voltage network is for example available in which a voltage of approximately 24 VDC or 90-400 VAC at frequencies between 50 and 60 Hz is provided which the power electronics converts into the voltages, currents and frequencies as required for the operation of the ionizing bar 20, in particular the respectively active electrode arrangement.

The power electronics comprises at least one voltage converter which converts a primary voltage provided by the primary electrical supply into a secondary voltage. The voltage converter thereby converts the primary voltage available e.g. as a low voltage into a medium voltage and/or a high voltage and makes it available to, for example, the electrode arrangement. Accordingly, such a high-voltage source is connected to the power electronics or can in particular constitute the power electronics or a part thereof. Furthermore, the power electronics for the respective electrode arrangement or respective high-voltage source can comprise at least one such voltage converter. In other words, the power electronics can comprise at least one such voltage converter for the positive electrode arrange-ment or for the positive high-voltage source respectively and at least one other such voltage converter for the electrode arrangement or for the negative high-voltage source respectively.

The power electronics can also have at least one frequency converter which converts a primary frequency of the primary voltage provided by the primary electrical supply. Such a frequency converter can in particular reduce and/or increase the primary frequency of the primary voltage. A primary alternating voltage can thus be converted into a direct voltage and/or a voltage at a frequency different from the primary frequency of the primary voltage. Analogous to the voltage converter, the respective electrode arrangement can thereby be provided with such a separate power electronics frequency converter.

The power electronics is connected to the control device in order to electrically supply the ionizing bar 20, particularly the at least one active electrode arrange-ment, pursuant to the respective requirements. The control device can thereby be designed or respectively programmed so as to control the power electronics, and in particular the respective high-voltage source, such that such a voltage as required to reduce the electrostatic charging of the material web is applied to the at least one electrode arrangement, in particular the associated electrodes.

According to one embodiment, the ionizing bar 20 comprises a sensor system which serves in detecting parameters of the ionizing bar 20 and/or material web. The sensor system could also aid in detecting parameters relative to an associated production facility.

The sensor system is appropriately connected to the control device and integrated into the cascade insert 1 of the ionizing bar such that the parameters detected by said sensor system are relayed to the control device in order to be further processed by said control device. In particular, the control device can be designed or respectively programmed so as to control the power electronics and/or the high-voltage source on the basis of the parameters detected via the sensor system. The parameters detected by the sensor system can for example be an operating state of the ionizing bar 20 and/or the material web and/or the production facility.

The sensor system can accordingly detect the speed at which the material web is moving, for example, and in particular whether the material web is motionless. The sensor system can additionally be designed or respectively configured so as to be able to detect a polarity of the material web. Alternatively or additionally thereto, the sensor system can be designed or respectively configured so as to be able to detect a neutralizing current flowing on the at least one active electrode arrangement due to the reduction in electrostatic charges on the material web.

The sensor system can advantageously also detect the voltages and/or currents provided by the power electronics of the respective electrode arrangement and/or other components of the ionizing bar 20 or cascade insert 1 respectively. To that end, the sensor system can be connected particularly to the power electronics and/or the respective high-voltage source and/or respective electrode arrangement.

The sensor system can in particular exhibit a sensor electrode arrangement comprising a plurality of individual needle-shaped sensor electrodes and electrically connected to a common ground, in particular grounded, during the ionizing bar 20 operation. Said neutralizing current and/or material web polarity can thereby be detected via the sensor electrode arrangement.

To improve the operability of the ionizing bar 20 and/or to improve the safety, the ionizing bar 20 preferably comprises a signaling device arranged on a side face of the outer housing 21. The signaling device can thereby be designed or respectively configured so as to output a signal as a function of at least one parameter of the ionizing bar 20 and/or material web and/or production facility, whereby the parameter is in particular able to be detected by the sensor system.

In preferential embodiments, the signaling device comprises an optical display device. In so doing, a signal can be reproduced optically and thus by way of an optical signal and/or optical signals.

The housing 2 of the cascade insert 1 is preferably filled with a potting material in which the cascade circuit 3 is preferably arranged.

A display device able to output at least two different optical signals is particularly conceivable as the optical display device. The optical display device can thus display two different colors, for example, and be designed e.g. as an RGB display. The optical display device can furthermore comprise at least one light-emitting diode (LED) and/or a pixel matrix designed for example in the form of an active matrix display of LEDs or as a liquid crystal display (LCD). Needless to say, the optical display device can output the optical signals by means of any given lighting units. These thereby including LEDs and/or LCDs, for example, as well as neon lamps, fluorescent tubes and the like.

The ionizing bar 20 can advantageously comprise one or more communication interfaces. Such a communication interface serves the purpose of ionizing bar 20 communication with another communication device. The communication device can be for example a computer, a controller, an operator panel and the like. The communication device in particular allows parameters of the ionizing bar 20 to be read out via the communication interface. Thus, it is for example also possible to communicate with the control device, particularly in order to change, activate, disable, etc., the control device's programming. The respective communication interface can thus constitute a communication connection arranged on or in the housing 2 of the cascade insert 1, for example a USB port 7.

The communication interface can in particular be designed as a wireless communication interface enabling wireless communication, thus in particular wireless transmitting and/or receiving of signals and/or communication data or respectively information. Such a communication point can thus be designed particularly as a wireless LAN (WLAN) interface and can communicate with any given device. The wireless communication interface therefore does away with the need for a corresponding connection 7 via cable and the like.

The invention is not limited to the embodiment depicted in the drawings as an example but rather yields from an integrated overall consideration of all the features disclosed herein.

The invention claimed is:

1. A cascade insert for an ionizing bar for non-contact neutralizing of electrostatic charges and/or for non-contact charging, particularly of insulating materials, wherein the cascade insert includes a housing having at least one cascade circuit comprising at least one transformer and a single or multi-stage cascade unit that are potted with potting material, and wherein an output of the at least one cascade circuit is capacitively, inductively or resistively coupled to a plurality of electrode tips accommodated in a carrier extending along the direction of extension of the housing, wherein control electronics for controlling the at least one cascade circuit are accommodated in the housing, and wherein the control electronics are provided in an end region of the housing and adjacent to one of the at least one cascade circuits, and wherein the carrier accommodating the plurality of the electrode tips of the cascade circuit extends in the longitudinal direction of the housing at least partially over the end region of said housing in which the control electronics are accommodated.

2. The cascade insert according to claim 1, wherein the at least one cascade circuit comprises a plurality of cascade circuits which are each cast in potting material in the housing and are arranged one behind the other, as viewed in the longitudinal direction of the housing.

3. The cascade insert according to claim 1, wherein at least one electrical connection for supplying energy to the at least one cascade circuit and at least one data interface for data communication with the control electronics are provided in an end face of the end region of the housing in which the control electronics are accommodated.

4. The cascade insert according to claim 3, wherein the at least one data interface and the control electronics are designed for bidirectional communication via a CAN bus.

5. The cascade insert according to claim 1, wherein an interface for manually inputting control commands to the control electronics and/or a display device, for optical output of information to the user of the cascade insert is/are preferably provided in an end face of the end region of the housing in which the control electronics is accommodated.

6. The cascade insert according to claim 1, wherein the at least one cascade circuit further comprises at least one digital oscillator likewise potted with the potting material.

7. The cascade insert according to claim 1, wherein the at least one cascade circuit and/or the control electronics is/are allocated at least one of the at least one digital oscillator.

8. The cascade insert according to claim 1, wherein the at least one cascade circuit comprises a plurality of cascade circuits that are accommodated in the housing and are arranged one behind the other as viewed in the longitudinal direction of the housing, and wherein individual cascade circuits of the plurality of cascade circuits accommodated in the housing can be switched on or off individually in order to change an operating mode of the cascade insert.

9. The cascade insert according to claim 1, wherein the at least one cascade circuit comprises a plurality of cascade circuits that are accommodated in the housing and are arranged one behind the other as viewed in the longitudinal direction of the housing, and wherein the plurality of electrode tips coupled to the plurality of cascade circuits accommodated in the housing are couplable to one another capacitively, inductively, resistively or galvanically.

10. The cascade insert according to claim 1, wherein the at least one cascade circuit comprises a plurality of cascade circuits that are accommodated in the housing and are arranged one behind the other as viewed in the longitudinal direction of the housing, and wherein the cascade circuits are accommodated in the housing in an individually interchangeable manner and are galvanically connected to one another via plug connections.

11. An ionizing bar for non-contact neutralizing of electrostatic charges, particularly of insulating materials, wherein the ionizing bar has an outer housing in the form of an open profile and at least one cascade insert according to claim 1, wherein the open profile of the outer housing exhibits a geometry adapted to the outer geometry of the housing of the at least one cascade insert such that the at least one cascade insert can be accommodated in the outer housing of the ionizing bar in an at least partially interchangeable manner.

12. The ionizing bar according to claim 11, wherein the outer housing includes a carrier extension aligned with the carrier of the at least one cascade insert in the longitudinal direction of the outer housing in which are accommodated a plurality of carrier extension electrode tips which are capacitively, inductively, resistively or galvanically coupled to the electrode tips accommodated by the carrier of the at least one cascade insert.

* * * * *